US007203971B2

(12) United States Patent
Claro

(10) Patent No.: US 7,203,971 B2
(45) **Date of Patent: *Apr. 17, 2007**

(54) BASEBALL STYLE HAT WITH SIZE ADJUSTMENT

(76) Inventor: Felipe Claro, Apoquindo 3721, 13h Floor, Las Condes, Santiago 6760352 (CL)

( * ) Notice: Subject to any disclaimer, the term of this patent is extended or adjusted under 35 U.S.C. 154(b) by 140 days.

This patent is subject to a terminal disclaimer.

(21) Appl. No.: 10/821,720

(22) Filed: Apr. 9, 2004

(65) Prior Publication Data

US 2004/0244096 A1 Dec. 9, 2004

Related U.S. Application Data

(63) Continuation-in-part of application No. 10/097,030, filed on Mar. 12, 2002, now Pat. No. 6,718,557.

(51) Int. Cl.
*A42B 1/00* (2006.01)

(52) U.S. Cl. ..... 2/195.2; 2/209.12

(58) Field of Classification Search ..... 2/171.1, 2/172, 171.5, 209.13, 195.2; 40/329
See application file for complete search history.

(56) References Cited

U.S. PATENT DOCUMENTS 1,419,771 A * 6/1922 Solomon ..... 2/195.2
2,101,107 A 12/1937 Probst
2,458,275 A 1/1949 Kriebel
2,556,807 A 6/1951 Gokiman
2,775,769 A 1/1957 Henschel
3,737,918 A 6/1973 Henschel et al. ..... 2/197
4,864,662 A * 9/1989 Frank ..... 2/183
5,603,121 A 2/1997 Borkovic et al.
6,175,963 B1 * 1/2001 Loeffelholz ..... 2/209.13
6,694,525 B1 * 2/2004 Murnan ..... 2/183
6,718,557 B2 * 4/2004 Claro ..... 2/195.2

FOREIGN PATENT DOCUMENTS

BR 9404150-4 A 6/1995

* cited by examiner

*Primary Examiner*—Katherine Moran
(74) *Attorney, Agent, or Firm*—Jackson & Co., LLP

(57) ABSTRACT

An adjustable baseball or sports type hat is disclosed having an adjustable circumferential portion along the bottom of the crown. A visor may be attached to the front or rear portion of the crown. A pair of adjustment clasps are affixed near each temple of the crown at or near where the visor is attached to the crown to alter the size of the circumferential portion of the crown. The adjustment clasps may be hidden when adjusted for the wearer or they may be attached on the exterior of the crown. In one embodiment the adjustment clasp is formed by a flap, which is formed above the temple of the crown where the edge of the visor attaches to the crown and has Velcro® on its underside which mates with Velcro® attached on the temple portion of the crown. The flap may be of any shape including that of a logo or trademark. A trademark or logo may also be affixed to the flap.

16 Claims, 8 Drawing Sheets

BASEBALL STYLE HAT WITH SIZE ADJUSTMENT

CROSS REFERENCE TO RELATED APPLICATION

This invention is a Continuation-in-part of U.S. patent application Ser. No. 10/097,030 entitled "Baseball Style Hat with Size Adjustment", filed 12 Mar. 2002 now U.S. Pat. No. 6,718,557 and is incorporated herein by reference in its entirety.

FIELD OF THE INVENTION

The invention relates to baseball or sporting type hats and in particular to adjustable baseball style hats that more resemble traditional fitted hats where the adjustment parts are generally symmetric in each side of the hat.

DESCRIPTION OF THE RELATED ART

Baseball or sports style hats are available in several styles. In the traditional style, the crown of the hat is made in a range of sizes and a user selects a hat to fit his head. The disadvantage of this style is that a vendor has to stock hats in many different sizes to accommodate different head sizes. The advantage of this traditional style is that the entire crown of the hat is made of material and no provisions are necessary to adjust the hat.

In recent years the "one-hat-fits-all" baseball hat has become very popular. An adjustment mechanism, such as a pair of plastic straps or Velcro® hook and loop straps, one a hook strap and the other a loop strap, are affixed at the back of the cap. The hat size is adjusted by altering the circumference of the crown by changing the position of the adjustment mechanism.

This style has several disadvantages. First, it requires a cut out or slit portion in the back of the crown where the straps of the adjustment mechanism are attached. This makes the hat unsightly in appearance. Second, it is popular to wear baseball style hats backwards, i.e., with the bill or visor at the back of the wearer's head instead of the front. In such case, the part of the head located at the split portion remains exposed to the weather conditions. With the traditional style hat this backwards wearing is both aesthetically pleasing and comfortable since the hat's material rests against the forehead of the wearer. But with the "one-hat-fits-all" style hat, the adjustment straps are on the forehead of the wearer. This is both unsightly and uncomfortable.

It is an object of the invention to provide a baseball style hat with or without visor which is neat in appearance and can be worn backwards without having a crown cut-out and adjustment mechanism on the wearer's forehead or back head.

Another object of the invention is to provide a baseball style hat with or without visor which is adjustable, but which does not have an adjustment mechanism in the back of the crown, at a cut-out of the crown.

A further object of the invention is to provide a baseball style hat with or without visor which has a pair of adjustment clasps which may be symmetrically located in both sides of the hat at or near where the edges of the visor are attached to the crown when the hat is worn by a user.

Another object of the invention is to provide a baseball style hat wherein an attachment clasp includes a flap located above the edge of the visor on the crown and the flap has any desired geometry including that of a logo, trade name or trademark.

Another object of the invention is to provide a baseball style hat wherein an attachment clasp includes a flap located above the edge of the visor on the crown and the flap has affixed thereon any desired logo, trade name or trademark. An additional object of the invention is to provide a baseball style hat with or without visor which has two or more adjustment clasps which are hidden from view when the hat is worn by a user.

In accordance with the invention, an adjustable hat is provided which has a crown, preferably made of a plurality of triangular sections, also referred to as panels, forming an apex at its top and having one or more adjustable portions along its lower part. A visor may be attached to the front or rear portion of the crown. A pair of adjustment clasps are affixed near each of the two temples of the crown to alter the size of the lower portion of the crown. The temples of the crown corresponds to the two portions which are at, or cover or are directly above a person's temple, which is generally in front of the ears and above the sideburns of a man's head.

In one embodiment, the adjustment clasps are hidden or almost hidden when adjusted for the wearer. This is accomplished by embedding one part of the adjustment clasp in or from a detachable flap, which can be created by leaving all, or a part of, adjacent panel or triangular sections unsown in both sides of the hat. The other part of the clasp is attached to the adjacent crown section, near the visor zone or forehead area. Preferably another set of adjustment clasps are attached to the opposite side of the hat.

The two part adjustment clasp can be a pair of straight or curved plastic straps, one having male connector portions and the other female connector portions, of the type well known in baseball style hats. The male-female connectors can be closer and/or narrower than commonly used in these kinds of hats. Alternately, the adjustment clasp can be a pair of Velcro® hook and loop straps, a textile strap with a buckle, hooks, screws, pins, clips, knots or similar fastener or even adhesive or elastic straps, also well known in the art.

In the preferred embodiment the adjustment clasps include a flap is formed which covers, or is at or above the temple of the crown where the edges of the visor attach to the crown. The flap may be attached along the seam of a triangular piece forming the crown where the triangular piece meets near the edge of the visor. The flap has Velcro® hooks or loops on its underside which mates with Velcro® hooks or loops attached on the bottom of the temple portion of the crown. The flap may be of any shape including that of a logo or trademark. A trademark or logo may also be affixed to the flap.

DETAILED DESCRIPTION

Figure 1:
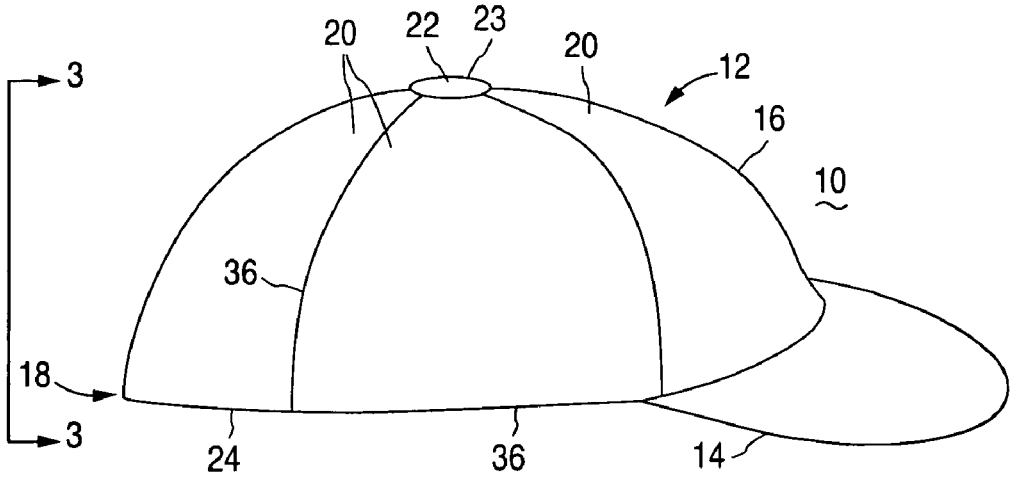
FIG. 1 is a side elevation view of the adjustable hat of the present invention.
Figure 2:
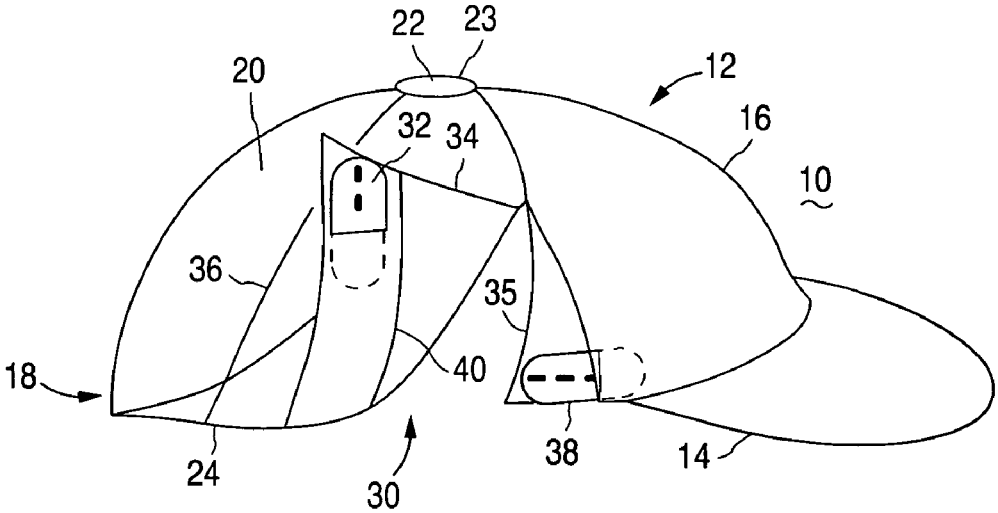
FIG. 2 is a side elevation view of the adjustable hat of the present invention showing one adjustment clasp arrangement.
Figure 3:
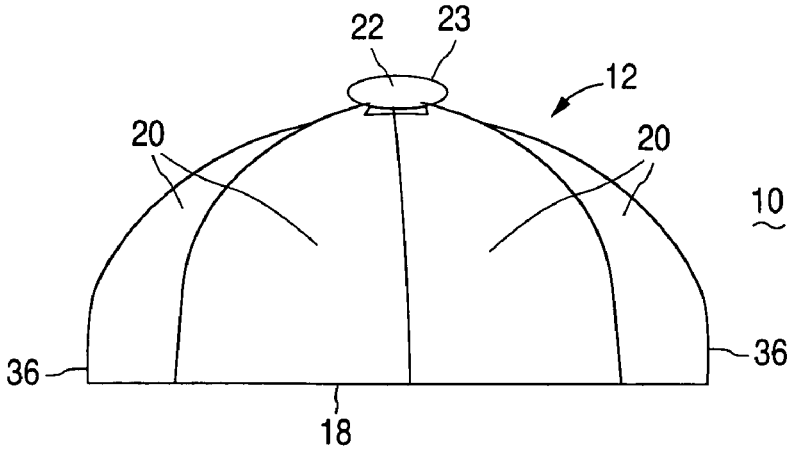
FIG. 3 is a back view of the hat of FIG. 1 in a direction of the arrows shown in FIG. 1.

FIGS. 1–3 illustrate one embodiment of the adjustable hat 10 of the present invention. The hat has a crown 12 and may have a bill or visor 14 attached to the front portion 16 or the back portion 18 of the crown 12. As can be seen in FIGS. 2 and 3, the back portion 18 looks like the traditional baseball style hat, e.g., there is a solid expanse of material with no slits and no visible adjustment mechanism or clasp. In a preferred embodiment, the crown is made up of a plurality of triangular, or pie-shaped, or panel pieces 20 of material such as cotton, wool or synthetic material.

With one or more exceptions the triangular or panel crown pieces 20 are sewn or stitched together, with the tips of the triangular pieces defining an apex 22, which is typically hidden by a button 23 as shown. The bottoms of the triangular pieces define the circumferential portion 24 of the hat 10.

FIG. 2 illustrates one embodiment of the improved adjustment mechanism or clasp 30 of the present invention comprising a first plastic strap 32 located in a flap 34 in the triangular temple piece 36 of the crown. A second part of the clasp comprises a second plastic strap 38 located in a flap 35 located in the adjacent triangle forming the crown where or near where the visor 14 joins the crown. Conveniently, the first and second plastic straps are sewn or fixed into the sweat band 40 of the hat, as indicated by the dashed lines. The plastic straps 32 and 38 are conventional or, one or more of them is wider and/or narrower and/or curved defining any desired geometry. The size of the hat is determined by the amount of overlap of the straps 32 and 38 when attached to each other.

Unlike the conventional "one-size-fits-all" style, the adjustment clasps are not located at the very back of the hat. Rather, they are generally located at both sides of the hat at the temple portion 26 of hat 10. As explained above the temples of the crown corresponds to the two areas which are directly cover or at, or above a person's temples, which are generally in front of the ears and above the sideburns of a man's head. Additionally, in a preferred embodiment, the adjustment clasps are generally hidden totally or partially, without the necessity of the slit in the crown, as is the case with the typical "one-size-fits all" style hat. In a preferred embodiment there are a pair of adjustment clasps, one at each side of the hat at the temple portion of the crown near or opposite where the bill or visor 14 joins the crown 12

Figure 4:
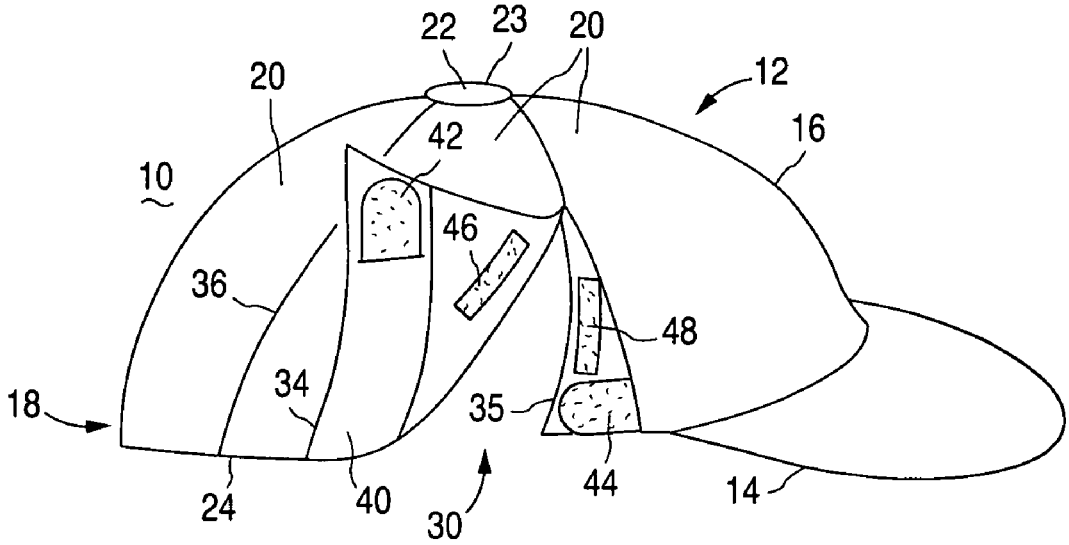
FIG. 4 is a side elevation view of the adjustable hat of the present invention showing another adjustment clasp arrangement.
Figure 5:
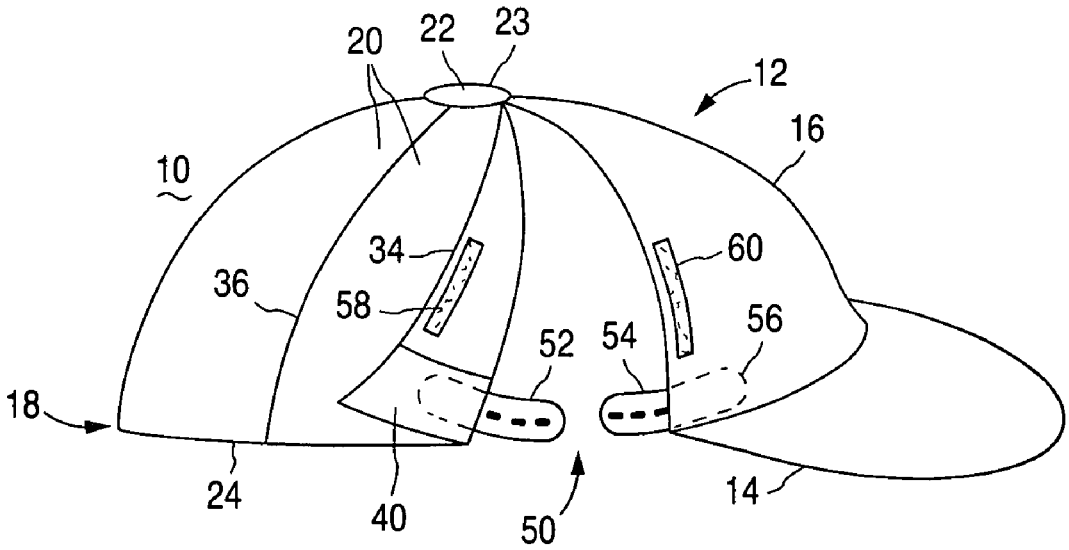
FIG. 5 is a side elevation view of the adjustable hat of the present invention showing yet another adjustment clasp arrangement.

As illustrated in FIG. 2, as well as FIGS. 4 and 5, the clasps 30 are provided in a manner such that they are virtually unseen when adjusted to the wearer's size, as shown in FIGS. 1 and 3. The first part 32, located in the flap 34, is hidden from view when it is attached to the second part of the clasp 38. In a preferred embodiment, flap 34 is created by leaving unsown all, or a part, of the temple triangle 36 to the adjacent triangular or panel section. The panel or triangular shape of each section may vary its shape to permit the mating movement of the clasp arrangement.

FIG. 4 shows another embodiment of the present invention. In this embodiment the clasp 30, located at the temple of the crown generally where the edge of visor 14 attaches to the crown comprises first and second Velcro® hook and loop straps 42 and 44, with one being the hook strap and the other the loop strap. The circumference of the hat, and hence its size, is adjusted by the amount of overlap of the straps 42 and 44.

FIG. 4 also illustrates another feature of the invention. One or more Velcro® hook and loop strips or patches 46 and 48 may be located along the flap 34 and adjacent flap 35. These strips or patches allow the detachable sections to be joined together once the adjustment clasp has been adjusted for the user. Velcro® hook and loop strips or patches 42 and 44 need not be rectilinear. They can be made to define a circle, or square or any desired geometry.

FIG. 5 illustrates another embodiment of the present invention. Here the clasp 50, located at the temple portion of the crown near the point the edge of visor 14 attaches to the crown, is made up of connectors 52 and 54 and have a slightly curved or arcuate shape to more naturally follow the contours of the circumference of the hat 10. One end of connector 52 fits into a recess of the crown triangle 36. Similarly, end 56 of connector 54 is recessed within the crown 12 above the visor 14.

In this embodiment, fold 34 of the crown triangle 36 extends all the way to the apex 22. Velcro® hook and loop strips 58 and 60 provide a mating surface for the flap 34 and the adjacent crown triangular section. Note that the width of the connectors 52 and 54 are preferably narrower than the single set of connectors typically found in the "one fits all" type of hat. Also, the embedded ends of connectors 52 and 54 can also be narrower than the connector portions. It should be understood that other clasps or adjustment mechanisms can be employed, as mentioned in the summary of the invention. Also, while keeping the adjustment clasps hidden is preferred, they may be provided on the outside of the crown where they are visible.

Figure 6A:
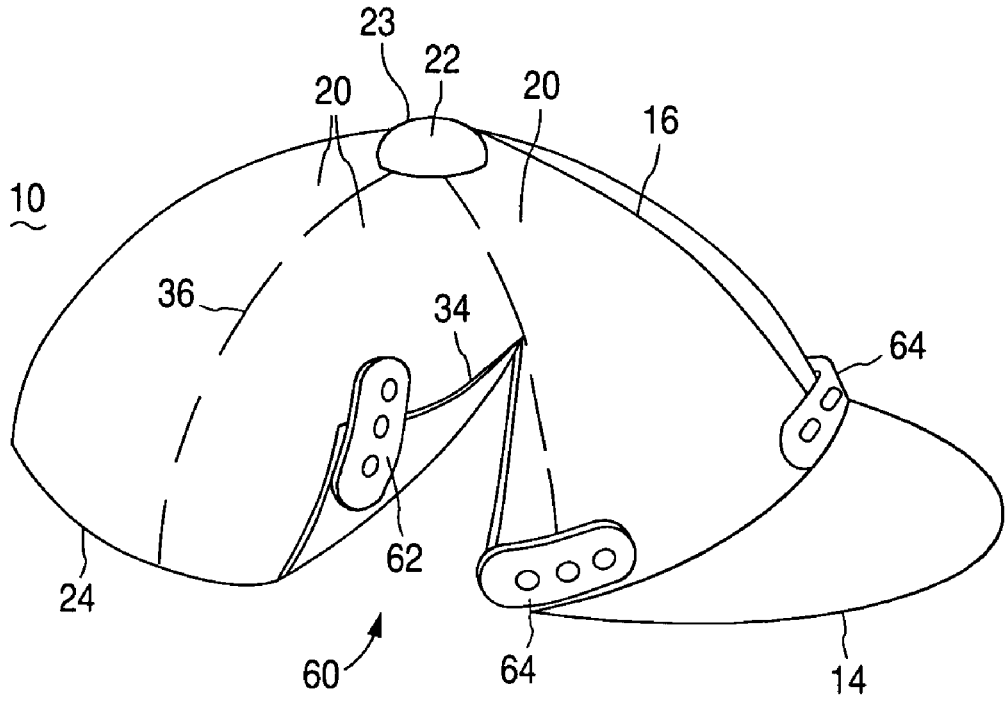
FIGS. 6A and 6B are front elevation of the adjustable hat of the present invention showing yet another adjustment clasp arrangement.
Figure 6B:
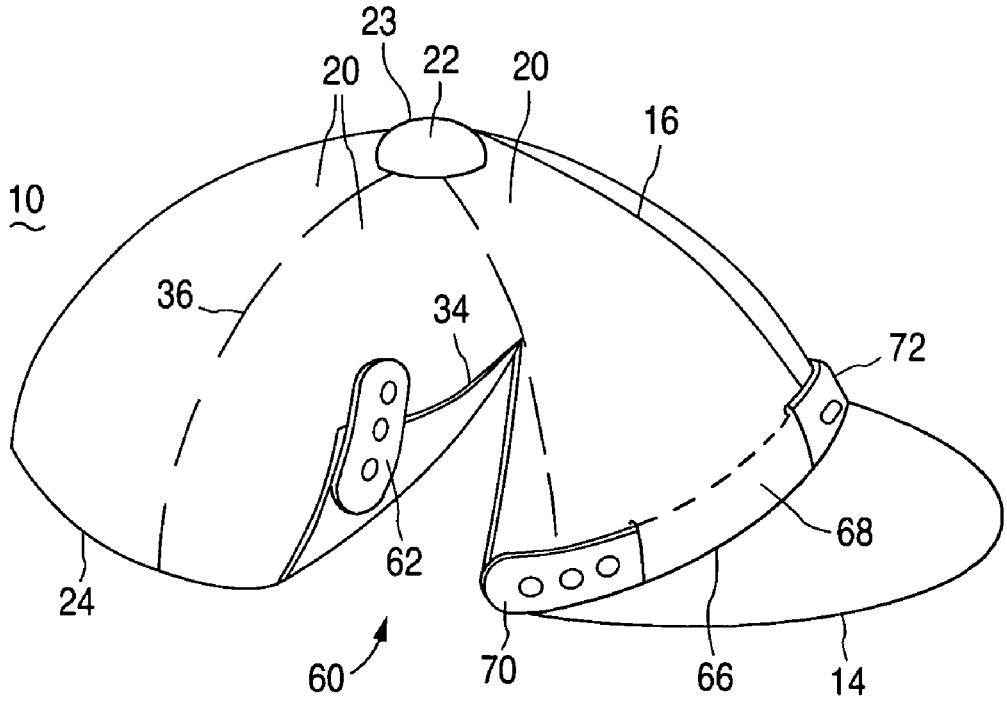

Another embodiment of the invention is shown in FIGS. 6A and 6B. In FIG. 6, the adjustment mechanism 60 includes a first pair of connectors, 62 and 64, which are attached to the inside flap 34 of temple triangle 36 and to the front portion 16 above the visor 14, respectively. A second pair of the same connectors 62 (not shown) and 64, are provided on the other side of the hat 10. Here mating connectors 64 are attached to the outside of the front portion 16 of hat 10 above the visor 14. For example, connectors 64 can be the male connectors and connectors 62 the female connectors or vice-versa. Connectors 62 and 64 can be made of, plastic, metal, textile, elastic, adhesive, Velcro® hooks and loops or can be a strap and buckle or hook arrangement. As explained above, if plastic, textile, metal, adhesive, elastic or Velcro® hooks and loops is used they can define any geometry and is not limited to a strap. For example, the receiving plastic, textile, metal, adhesive, elastic or Velcro® hooks and loops could be round or square or have any desired geometry for easy attachment of strap 62. It should be understood that other clasps or adjustment mechanisms can be employed, as mentioned in the summary of the invention.

FIG. 6B is similar to the embodiment of FIG. 6A except that instead of two separate connectors 64, a single plastic, textile, metal, elastic, adhesive or Velcro® hook and loop strip 66 is embedded in the front portion of the hat 10 along the brim of the hat where the visor 14 is joined. The central area 68 is enclosed in fabric at the front portion 16. Ends 70 and 72 adjustably engage the pair of connectors 62. Of course, other types of adjustment clasps can be used.

Figure 7A:
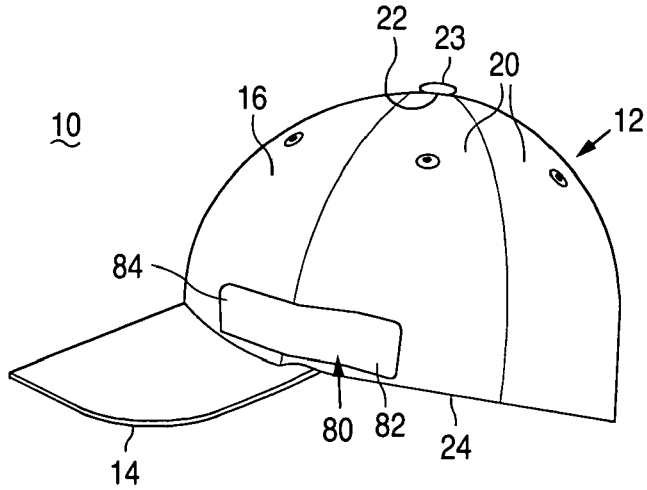
FIGS. 7A, 7B and 7C are side and elevation views-of the adjustable hat of the present invention showing yet another adjustment clasp arrangement.
Figure 7B:
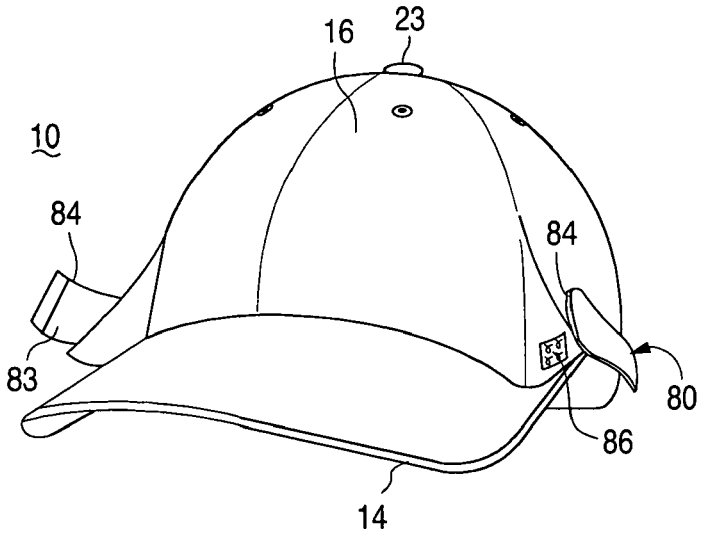
Figure 7C:
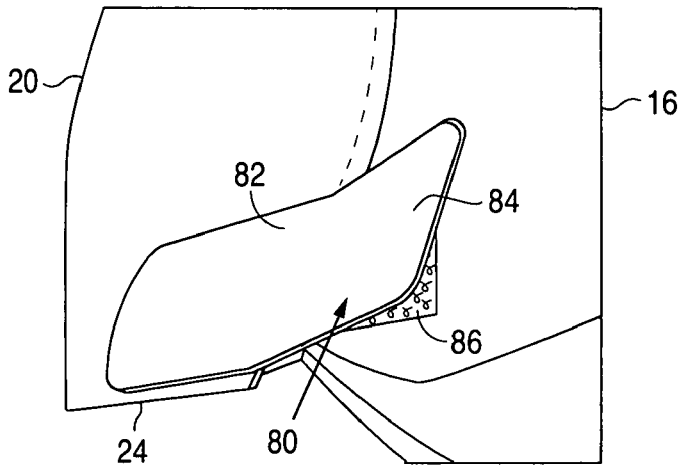

Another embodiment of the invention is shown in FIGS. 7A, 7B, and 7C. Here the adjustment clasp 80 includes a strap 82, having a Velcro® hooks and loops underside 83, which is attached to the outside of the crown along the circumference 24. The distal end 84 of strap 82 also extends along the circumference 24 of the crown, where the visor 14 joins the crown. Distal end 84 adjustably attaches to a Velcro® hook and loop mating patch 86 located on the front portion just above the visor. Of course, the visor can be located at the rear side of the hat and the Velcro® hook and loop patch 86 can have any desired geometry suitable for mating with Velcro® hooks and loops 83 on distal end 84.

Another embodiment of the invention is shown in FIGS. 7A, 7B, and 7C. Here the adjustment clasp 80 includes a strap 82, having a Velcro® underside 83, which is attached to the outside of the crown along the circumference 24. The distal end 84 of strap 82 also extends along the circumference 24 of the crown, where the visor 14 joins the crown. Distal end 84 adjustably attaches to a Velcro® mating patch 86 located on the front portion just above the visor. Of course, the visor can be located at the rear side of the hat and the Velcro® patch 86 can have any desired geometry suitable for mating with Velcro® 83 on distal end 84.

Strap 82 can have a slight curve to it to correspond to the natural curve of a baseball style hat or to the adjusting movement of the clasp arrangement. This embodiment also considers each strap 82 being laurel shaped, so that the two clasp arrangements form a laurel wreath. This embodiment also considers a buckle mounted at the border of the crown 24 (in a manner similar to the mounting of a buckle in the crown of a traditional adjustable hat, so that the loose end of the strap can be embedded into the sweat band) and the distal end of the strap 84 fixed into the front portion 16.

Figure 8A:
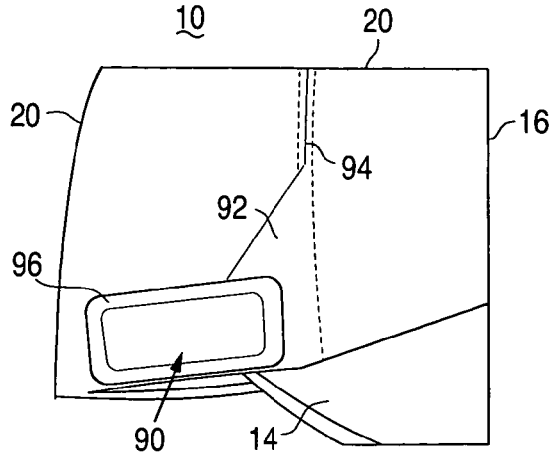
FIGS. 8A and 8B are views of another embodiment of the clasp arrangement of the adjustable hat of the present invention.
Figure 8B:
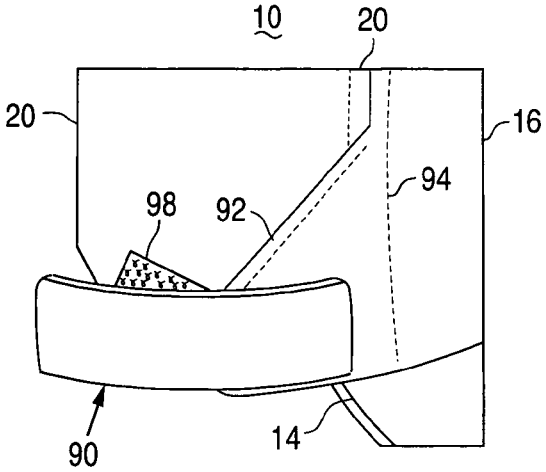

Another adjustment clasp embodiment 90 is shown in FIGS. 8A & 8B. Adjustment clasp 90 includes a flap 92 secured along or near one edge at the seam between the front portion 16 and the panel or triangular portion 20 above the temple where the edge of the visor 14 meets the crown. The underside of distal end 96 is provided with a Velcro® hook and loop patch (not shown) which adjustably engages a mating Velcro® hook and loop patch 98 located on the temple portion 20. Once again, the Velcro® hook and loop patch 98 can be of any geometric shape. Also, flap 92 and/or clasp 90, although shown her as being triangular, can have any geometric shape such as a truncated triangle, oval or rectangle or any desired geometry suitable for mating the Velcro® hook and loop patch and the portion 20. Clasp 90 and/or flap 94 can also be made to have the shape of a logo, trademark or trade name. Additionally, a logo, a trademark or a trade name can be provided or stitched on the surface of clasp 90/94.

Figure 9A:
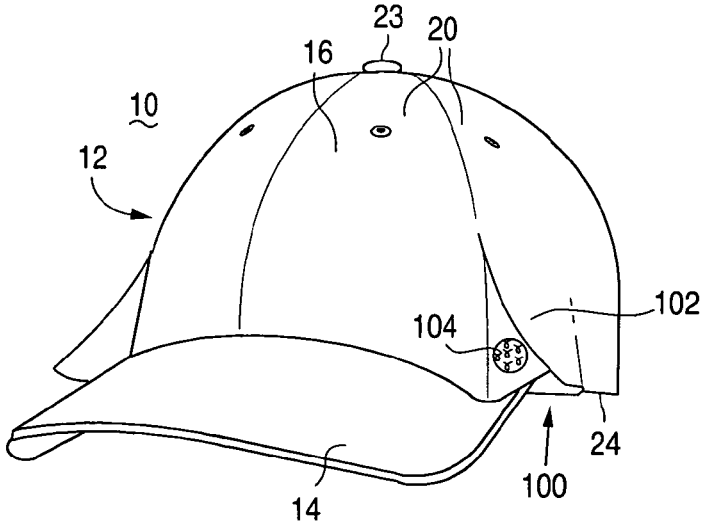
FIG. 9A is a view of another embodiment of the adjustable hat of the present invention and FIG. 9B is a view of the details of the clasp arrangement of this embodiment.
Figure 9B:
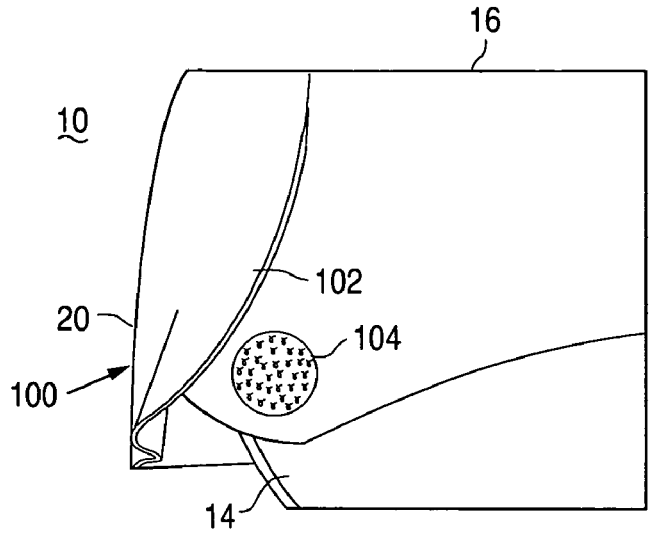

FIGS. 9A and 9B show another embodiment of an adjustable hat 10, having an adjustment mechanism 100. Here, the triangular portion 20 forms a flap 102 which has one part of a Velcro® hook and loop attachment (not show) along its underside. Flap 102 mates with a Velcro® hook and loop patch 104 affixed to a front portion 16 above the bill 14. In other words, the edge of flap 102 lies along the seam between triangles 20 at or above where the visor edges 14 attach to the crown. Of course, the visor can be located at the rear side of the hat and the patch 104 can have other geometric shapes.

Figure 10A:
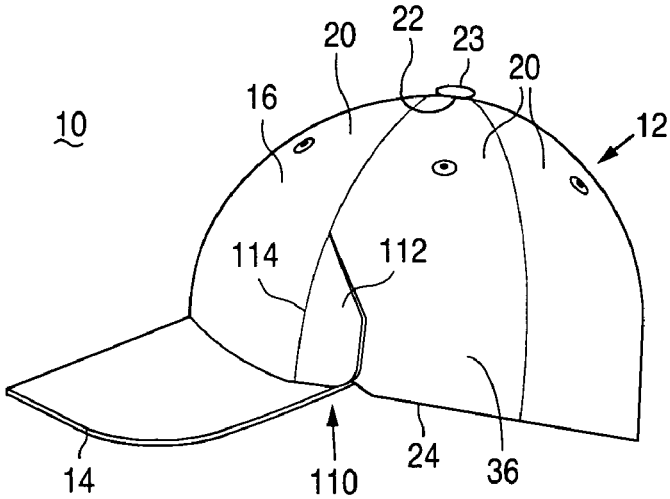
FIG. 10A is a view of another embodiment of the adjustable hat of the present invention and FIG. 10B is a view of the details of the clasp arrangement of this embodiment.
Figure 10B:
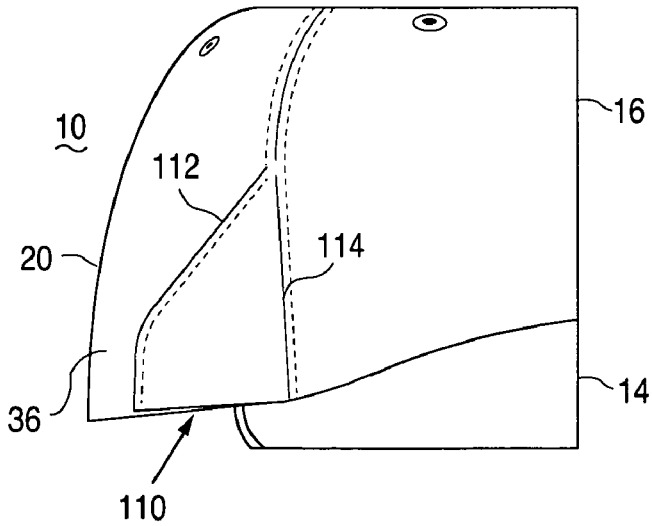

FIGS. 10A and 10B show yet another embodiment of an adjustable hat 10 having an adjustable clasp 110. Adjustable clasp 110 includes a flap 112 which is attached at or near the seam between the front portion 16 and a temple triangle or panel 36 at or near where the edge of visor 14 attaches to the crown. Flap 112 has a truncated triangular configuration, but it may be any desired shape, such as winged shaped, triangle, oval or rectangle or any desired geometry, suitable for mating the Velcro® hook and loop patches and the portion 20 Flap 112 can have a geometry which corresponds to a logo, trademark or trade name or any other design or shape. Also, a logo, trademark or trade name or any other design or shape can be affixed such as by stitching it to the surface of the flap 112. A Velcro® hook and loop patch on the underside of flap 112 (not shown) mates with a Velcro® hook and loop patch on section 20 (not shown) on the bottom of the temple portion of the crown near the edge of visor 14.

Figure 11:
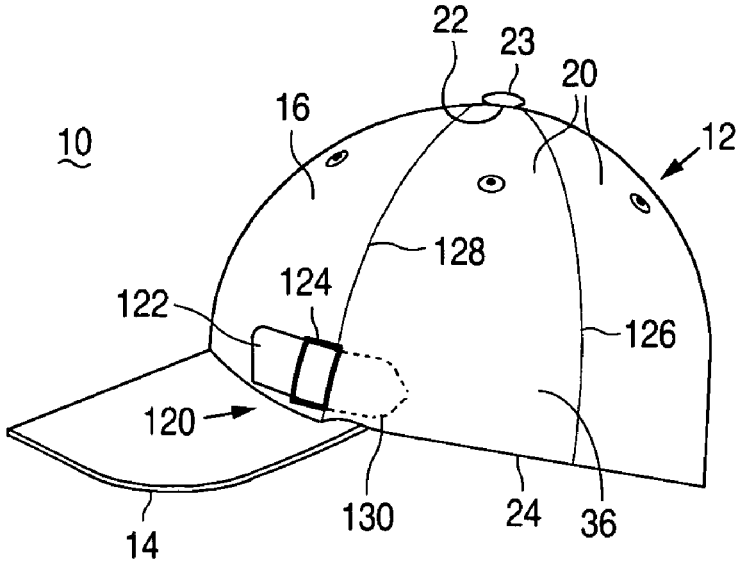
FIG. 11 is a view of another embodiment of the adjustable hat of the present invention.

FIG. 11 shows another embodiment of an adjustable hat 10, having an adjustable clasp 120. A strap 122 is secured, such as being sewn, in the front portion 16 of the hat 10. A buckle 124 is attached to the temple triangle 36, preferably along its underside, the buckle 124 allowing the user to adjust the fit of the hat. Temple triangle or panel 36 is attached to adjacent triangle 20 along seam 126. It is left unattached along at least a part of its length, at its other edge 128, in the manner shown in FIGS. 7A–7C.

The free end 130 (shown in dotted lines) if the strap 122 passes through the buckle 124 allowing the user to adjust the fit of the hat, The further the free end passes through the buckle, the more the crown triangle is pulled towards the 0 front of the hat, thereby making the circumference 20 of hat 10 smaller. The free end 130 of the strap can be hidden from view by providing an underside exit from buckle 124. Alternatively, a small vertical cut can be made in the temple triangle 36 just beyond the buckle to allow the free end to pass within the circumference 20 of hat 10 along the sweatband.

Any number of style buckles can be employed in this and the other embodiments described herein. For example, buckle 124 may be of the type having a pivot axis, which when open, allows the strap 122 to pass through it. When properly adjusted the buckle is pivoted downwardly to clamp the strap in place. Alternatively, the buckle can be a "belt buckle" type with a tongue engaging holes in the strap. Another type of buckle has a generally circular ring with entry and exit apertures. When tightened friction, or a friction device, keeps the strap in place. Other buckles of course may be employed.

Figure 12:
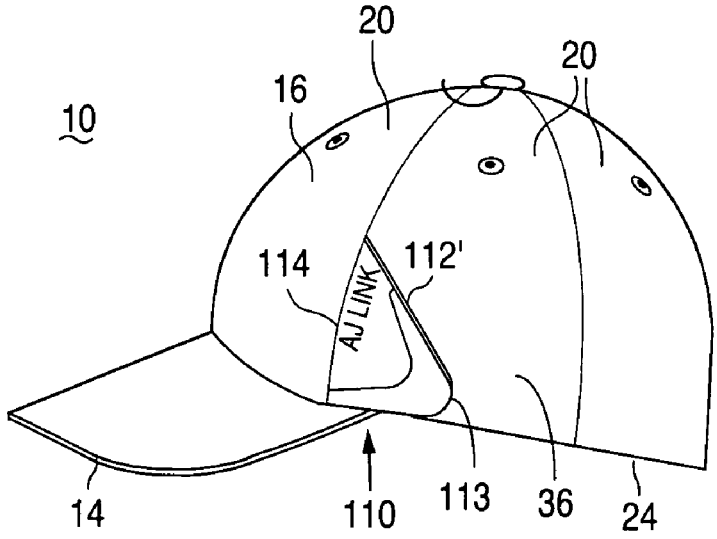
FIG. 12 illustrates the embodiment of the adjustable hat of the FIGS. 10A & 10B wherein the adjustment flap itself is configured as a logo

FIG. 12 shows the embodiment of FIGS. 10A & 10B wherein flap 112' is configured as a logo. In this case flap 112' has a generally triangular configuration with a slightly rounded tip 113. Additionally a logo is imprinted or stitched on to flap 112', in this case the trademark "AJ Link™" plus a multi-colored logo. Of course the flap could be made to have any other shape corresponding to a desired logo or trademark.

Figure 13:
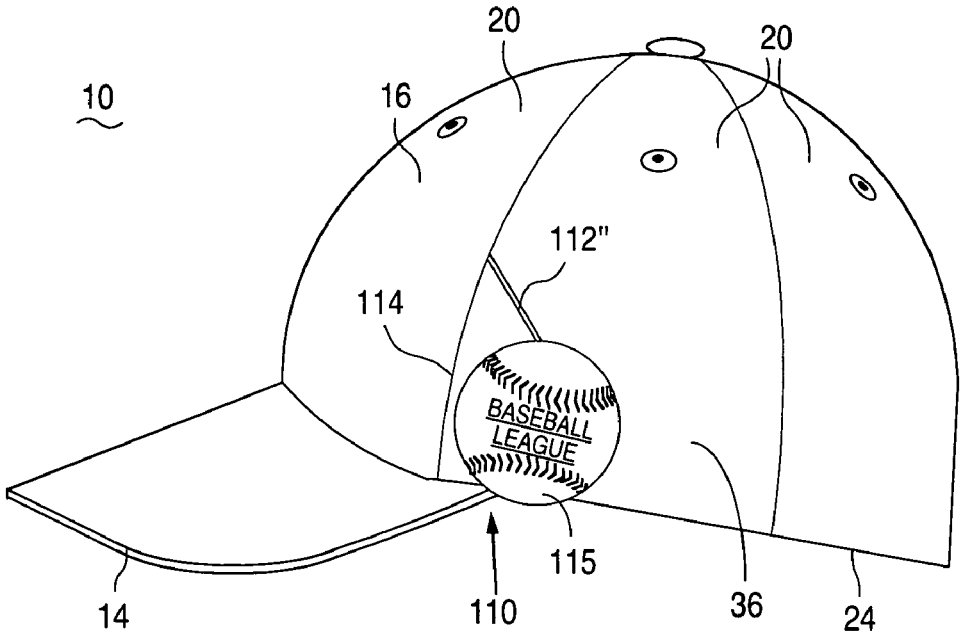
FIG. 13 illustrates the embodiment of the adjustable hat of the FIGS. 10A & 10B wherein the adjustment flap has a logo formed thereon.

FIG. 13 shows the embodiment of FIGS. 10A & 10B wherein flap 112" has a logo affixed to it. In this case the logo is a baseball 115 which is affixed, such as by stitching it, to flap 112". Of course any logo or trademark could be so affixed to the flap 112". Of course the logo can be affixed to the flap by any number of means including thermal transfer.

Figure 14:
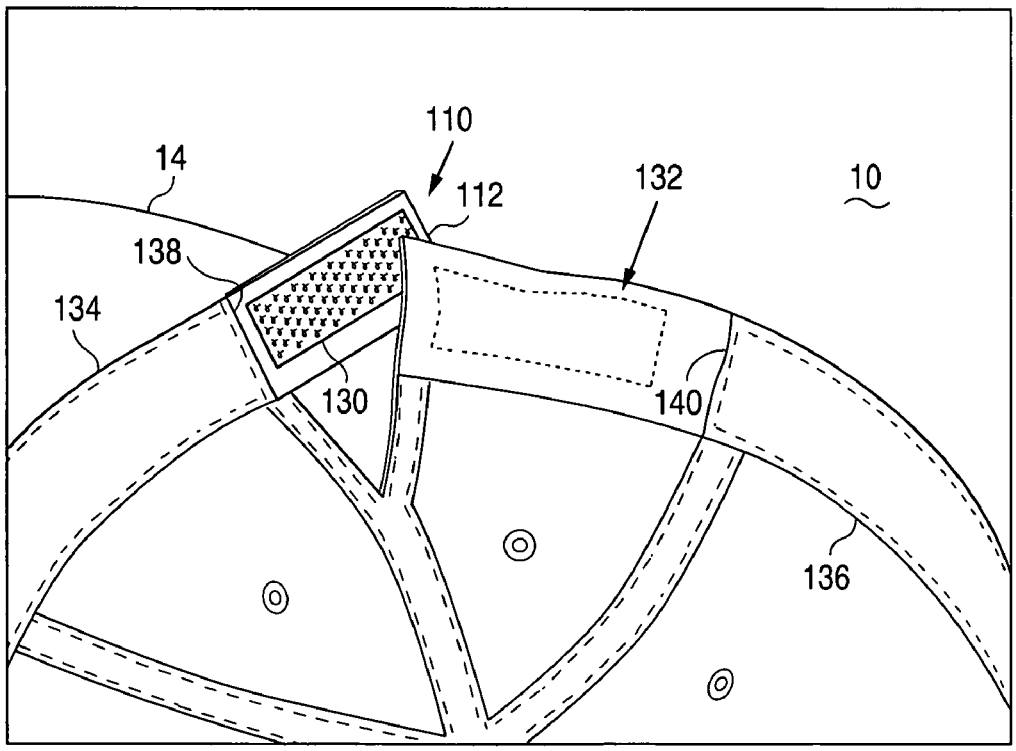
FIG. 14 is a view from underneath the adjustable hat of FIGS. 10A & 10B showing another embodiment of the adjustable hat of the present invention wherein the sweatband is removed in the area of the flap adjustments.

FIG. 14 is a view of the adjustable baseball hat 10 of FIGS. 10A & 10B of the present invention viewed from within the hat looking towards the top of the crown. The adjustable clasp 110 is shown in an open position. Attached to flap 112 is one of the two parts of a Velcro® hook and loop strap 130. The mating Velcro® hook and loop strap 132 is attached on the outside of the temple triangle or panel 36. A sweatband 134 is attached, such as by stitching, at the front of the hat along the inner circumference of the crown. Another sweatband 136 is also affixed along the inner circumference of the crown. In the preferred embodiment the end 138 of sweatband 134 terminates at approximately the beginning of the flap 112 before the Velcro® hook and loop strap 130. Similarly, the end 140 of sweatband 136 terminates before the location of Velcro® hook and loop strap 132. In other words, there is an absence of a sweatband along the circumference of the hat 10 underneath the clasp 110. The purpose of this is to keep the bulk of the hat to a minimum in the area of the flap 112 to give the hat a thin and natural appearance. Of course, the sweatband can be extended into the region under the flap if desired.

As is the case of all of the embodiments described herein having a strap, the strap may be made of a fabric, leather, simulated leather, plastic, or other materials. The present invention is not limited to the particular connector or adjustment mechanisms described herein. For example, other types of connector mechanisms can be used, such as buckles, tooth-type clasps, adhesives, screws, bolts, hooks, pins, clips, buttons, knots, and elastic band connectors can be used. Also, the present invention is not limited to baseball or sports-type hats. It is equally applicable for other types of hats or helmets, such as hats without visors. It also refers to hats that permit the mounting, holding or inclusion of electronic, media, audio or optical accessories or devices, so that the hat is designed to support headsets, headphones, antennas, viewfinders, screens, magnets, batteries, microphones, cameras, sensors, controls, remotes, earplugs, player or recording machines, films, cards, games, computers, cassettes, discs, lenses, watches, compasses, lights, phones, televisions, connectors, jacks, plugs can be a part of or be attached or connected to the hat and therefore a part of the hat. The clasp arrangements are ideal for clipping any desired electronic; media, audio or optical device, because each clasp arrangement is generally placed between the ears and the eyes and above the mouth. People have the opportunity to wear a new kind of 'hands-free' cap, using electronic devices near or within the visor zone. The clasp arrangements can also be used to support flagpoles, sticks, whistles, keys, jewelry, makeup, lighters, first aid, cutters, cards, containers, mirrors, stationery, tees, fishhooks, nets, tools, utensils, food, clothing, pacifiers or any desired object.

What is claimed is:

1. An adjustable hat comprising:

a crown having an adjustable circumferential portion at its bottom and having front and back portions and two side portions;

a visor attached to the front or back portion of the crown;

a pair of adjustment clasps to alter the size of the circumferential portion of the crown;

a plurality of panels forming the crown;

a pair of flaps each with an outer surface and an underside and each attached between adjacent panels nearest the edge of the visor to hide or partly hide the adjustment clasps;

wherein each of the pair of adjustable clasps comprises, (a) a strap or patch attached at one end of the flap and having on the underside of the flap one part of a clasp chosen from a group comprising plastic, metal, magnetic, elastic, adhesive, and/or textile, and hooks and loops; and (b) a mating strap or patch on the crown near the visor selected from the group comprising plastic, metal, magnetic, elastic, adhesive, textile subtended by the visor.

2. An adjustable hat as in claim 1 wherein the mating strap or patch is located on the crown above the visor.

3. An adjustable hat as in claim 1 wherein the mating strap or patch is located on the crown subtended by the visor.

4. An adjustable hat as in claim 1 wherein the mating strap or patch is located on the side portion between the ears and eyes of the wearer.

5. An adjustable hat as in claim 1 wherein the mating strap or patch is secured to the exterior of the crown between the ears and eyes of the wearer.

6. The adjustable hat of claim 1 wherein the flaps have a shape of a logo or have a logo affixed thereto.

7. An adjustable hat comprising:

a crown having an adjustable circumferential portion at its bottom and having front and back portions and two side portions and wherein the crown is formed by a plurality of panels;

a visor, having side edges, attached to the front portion of the crown;

a pair of flaps each formed at the junction of the front and side portions near the side edges of the visor and wherein each flap is attached between adjacent panels nearest the edge of the visor;

a pair of hook and loop adjustment clasps to alter the size of the circumferential portion of the crown, wherein each of the pair of adjustable clasps is located with (a) one part of the clasp located within the flap; and (b) the mating clasp on the crown; and wherein the pair of flaps hides or partially hides the pair of adjustment clasps.

8. The adjustable hat of claim 7 wherein the flaps are of any desired shape.

9. The adjustable hat as in claim 8 wherein each flap has an outer surface and an underside surface and wherein the one part of each of the clasps mounted on the flap is mounted on the underside of the flap.

10. The adjustable hat of claim 8 wherein the geometry of the flap comprises a logo.

11. The adjustable hat of claim 10 wherein a logo is affixed to the outside surface of the flap.

12. An adjustable hat comprising:

a crown having an adjustable circumferential portion at its bottom and having front and back portions and two side portions and wherein the crown is formed by a plurality of panels;

a visor, having side edges, attached to the front portion of the crown;

a pair of flaps each formed at the junction of the front and side portions near the side edges of the visor and wherein each flap is attached between adjacent panels nearest the edge of the visor;

a pair of magnetic adjustment clasps to alter the size of the circumferential portion of the crown, wherein each of the pair of adjustable clasps is located with (a) one part of the clasp located within the flap; and (b) the mating clasp on the crown; and wherein the pair of flaps hides or partially hides the pair of adjustment clasps.

13. The adjustable hat of claim 12 wherein the flaps are of any desired shape.

14. The adjustable hat as in claim 13 wherein each flap has an outer surface and an underside surface and wherein the one part of each of the clasps mounted on the flap is mounted on the underside of the flap.

15. The adjustable hat of claim 14 wherein the geometry of the flap comprises a logo.

16. The adjustable hat of claim 15 wherein a logo is affixed to the outside surface of the flap.

* * * * *